US010525648B2

(12) United States Patent
Williams

(10) Patent No.: US 10,525,648 B2
(45) **Date of Patent: *Jan. 7, 2020**

(54) METHOD AND DEVICE FOR COMPACTING MATERIALS

(71) Applicant: Richard T. Williams, Lewis Center, OH (US)

(72) Inventor: Richard T. Williams, Lewis Center, OH (US)

(73) Assignee: Richard T. Williams, Lewis Center, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/859,143

(22) Filed: Dec. 29, 2017

(65) Prior Publication Data

US 2018/0117868 A1 May 3, 2018

Related U.S. Application Data

(63) Continuation-in-part of application No. 13/969,357, filed on Aug. 16, 2013.

(51) Int. Cl.
*B30B 1/32* (2006.01)
*B30B 9/30* (2006.01)
(Continued)

(52) U.S. Cl.
CPC ..... *B30B 1/32* (2013.01); *B30B 9/301* (2013.01); *B30B 9/3014* (2013.01); *B30B 9/3021* (2013.01); *B30B 9/3032* (2013.01); *B30B 9/3046* (2013.01); *B30B 9/3092* (2013.01); *B65F 3/00* (2013.01); *B65F 3/201* (2013.01);
(Continued)

(58) Field of Classification Search
CPC ... B30B 9/3021; B30B 9/3032; B30B 9/3057; B30B 9/3046; B30B 9/3082; B30B 9/3014; B30B 1/32; B30B 9/301; B30B 15/30; B30B 9/3092; B65F 3/24; B65F 3/28; B65F 3/207; B65F 3/26; B65F 3/201;
(Continued)

(56) References Cited

U.S. PATENT DOCUMENTS 2,084,656 A * 6/1937 Rottee ..... B65F 3/08 414/501
3,195,448 A * 7/1965 Larsen ..... B30B 9/30 100/229 A
(Continued)

FOREIGN PATENT DOCUMENTS

DE 3244216 A1 * 6/1983 ..... B30B 9/3046
FR 2757443 A1 * 6/1998 ..... B30B 9/3014
GB 2110591 A * 6/1983 ..... B30B 9/3046

*Primary Examiner* — Jimmy T Nguyen
(74) *Attorney, Agent, or Firm* — Dickinson Wright PLLC

(57) ABSTRACT

A method and system for compacting waste materials in a collection container. The container can be a freestanding waste container, a self-contained compaction container, or a container on a waste collection vehicle. A hydraulically operated compactor blade is positioned in the upper portion of the container with its bottom edge a distance above the floor. A door member can be provided in the rear wall of the collection container. The compactor blade can be in its rest position relative to the top opening. The container member can be positioned or located on a trailer or truck-type vehicle and adapted to be tilted for evacuation of materials collected therein.

29 Claims, 8 Drawing Sheets

(51) Int. Cl.

| | |
|---|---|
| ***B65F 3/20*** | (2006.01) |
| ***B65F 3/00*** | (2006.01) |
| *B65F 3/02* | (2006.01) |
| *B65F 3/26* | (2006.01) |

(52) U.S. Cl.
CPC ..... *B65F 3/207* (2013.01); *B30B 9/3057* (2013.01); *B65F 3/001* (2013.01); *B65F 3/26* (2013.01); *B65F 2003/0279* (2013.01)

(58) Field of Classification Search
CPC .. B65F 2003/0279; B65F 1/004; B65F 3/001; B65F 3/046; B65F 3/08; B65F 3/045
USPC ..... 100/100, 233, 240, 241, 245, 251, 250, 100/225; 414/469, 525.51, 525.52, 525.5, 414/409
See application file for complete search history.

(56) References Cited

U.S. PATENT DOCUMENTS 3,802,585 A * 4/1974 Churchman ..... B65F 3/28 414/512
4,576,540 A * 3/1986 Derain ..... B65F 3/28 100/295
5,716,103 A * 2/1998 Kann ..... B65F 1/004 298/1 B
5,868,543 A * 2/1999 McNeilus ..... B65F 3/001 414/512
5,885,049 A * 3/1999 McNeilus ..... B65F 3/001 414/512

* cited by examiner

METHOD AND DEVICE FOR COMPACTING MATERIALS

CROSS-REFERENCE TO RELATED APPLICATIONS

This application is a continuation-in-part of U.S. patent application Ser. No. 13/969,357, filed on Aug. 13, 2013, which is incorporated herein by reference in its entirety

TECHNICAL FIELD

The present invention relates to material compacting, and more particularly to industrial waste compactor systems and waste collection vehicles.

BACKGROUND

Methods and devices for picking up, storing and disposing of waste materials are in common use today. The devices include compactors with receiver containers, self-contained compactors and waste vehicles, among other devices and systems.

Stationary compactor systems typically include a compactor mechanism and one or more large metal box-like containers. The containers are put in a location adjacent the compactor device when empty, and then picked up when loaded. The loaded containers are then taken to a landfill or dump site and unloaded. At a site where containers are required continuously, empty containers are typically dropped off when the loaded containers are picked up. The containers typically have wheels or slide rails on the bottom so they can be more easily moved into position and loaded and unloaded on a vehicle.

Trash and other waste materials are loaded into the containers typically at a door at one end, or an opening in the top surface. A hydraulically operated pusher blade in the compactor device can be used to compact materials in some systems. Once compacted, the blade is returned to its rest position so additional materials can be loaded. Once the container is fully loaded, it is picked up (typically by a truck with a bed) and usually replaced with an empty container.

Waste collection vehicles (commonly called "garbage trucks") have a large storage container on the back of the vehicle behind the cab and typically are made in two basic styles: a rear loading style, and a front loading style. The rear loading style has an opening in the lower portion at the rear of the truck where the trash can be loaded. Once a portion of the trash or waste is loaded, a hydraulically actuated blade member is used to transfer the trash toward the front of the container. A second hydraulically actuated blade member is then used to compact the trash inside the container. The front loading style has an opening in the top of the container behind the cab and uses hydraulic-actuated arms to pick up loaded dumpsters or waste containers and dump them into the opening. The waste materials are then compacted by a hydraulically operated blade member inside the container. Once loaded, both styles of waste trucks are driven to a landfill or other location where the loads are dumped out or ejected. Once empty, the trucks are available to pick up more trash and repeat the process.

Both of these types of compactors, i.e. the waste compactor systems and the waste collection vehicles, have concerns that need improvement. The forces necessary to adequately compact the trash and waste materials require heavy and strong metal structures. There are expensive and add to the total weight of the load. Collection containers and vehicles constructed of lighter and weaker materials would require additional expense and maintenance to prevent premature failure. Also, the present systems often require manual cleaning to remove loose materials, particularly those which become lodged behind the compaction blades.

In addition, the present collection containers, either freestanding or on waste collection vehicles, are inefficient in that they often leave significant voids and open areas in the compacted loads. Also, the compacted materials typically "fall-back" causing de-densification during blade retraction. The incomplete filling causes unnecessary trips for unloading over a given period of time. Further, the present collection members typically are not water tight and allow liquids in the waste materials to leak out. This also causes messy and time consuming clean ups.

There is a need in the waste collection field for compactor systems and compactor vehicles which are more efficient and can fill a larger percentage of the volume inside the containers. There further is a need for compactors which are more energy efficient and which do not cause premature wear on the container or components.

SUMMARY OF THE INVENTION

The present invention has particular use, but is not to be limited to, freestanding waste collection systems and front-loading waste collection vehicles. The inventive system utilizes a compactor blade member which is located at an elevated (raised) position above the floor of the waste containers and preferably adjacent the upper or top wall of the container. Preferably, the blade member has a vertical height about 20-80% of the vertical height of the cavity. The blade member is hydraulically operated and preferably guided by guide rails positioned on the sidewalls or upper walls of the containers.

As waste materials are introduced into the waste container through a door or opening in the ceiling or upper walls, the compactor blade is activated. This levels out the materials in the container and compacts a portion of the materials against the opposite end of the container. The heavier or more dense waste materials settle at the bottom portions of the collection container, while the lighter and less dense materials are pushed longitudinally along the existing filled volume of waste materials in the lower level of the container. As the volume of the container is filled, more and more of the materials will be compacted against the opposite end and vertically downwardly. Some of the waste material can also be pulled back in the retraction direction of the compactor blade in order to fill any open spaces. The compactor blade can be hydraulically operated in either a push or pull-type hydraulic system.

One embodiment of the present invention has two compartments in the container in order to collect different types of waste materials. This embodiment has particular use in collecting normal waste or trash materials in one compartment, and collecting recyclables in the other compartment, or in collecting two separate types of recyclable materials (e.g. paper and plastic). One method utilizes a platform or shelf located below the container entry opening and the materials can be pushed or pulled one way or the other, into the first or the second compartments, depending on the type of materials being introduced into the container. The platform also can have a hinged or moveable wall or partition so that the two compartments can be separately emptied. Removal openings or doors can be provided at one end or alternatively at each end of the container.

One of the benefits of a preferred embodiment of the invention is that materials in the container can be discharged from the same end of the container where the compactor blade is located. This allows the container to be located on a bed of a truck or on a trailer (pulled, for example, by a pick-up truck). Tilting of the container allows it to be emptied through a door behind or below the compactor blade. In another embodiment, the compaction blade is positioned at the front end of the container and compacts the materials rearward toward the rear wall which has a discharge door. Movement of the compaction blade can be utilized to assist in emptying the cavity or compartments in all of the embodiments.

Further features and benefits of the invention will become apparent from a review of the following detailed description, together with the accompanying drawings and appended claims.

DESCRIPTION OF THE PREFERRED EMBODIMENTS

The present invention will be described herein with respect to uses relative to waste collection containers and front-loading waste collection vehicles. It is to be understood, however, that the present invention can be used on other containers and other vehicles, and for purposes other than waste collection and disposal. In this regard, the invention can be used, and has utility and benefits for use, with any structures, equipment, and vehicles falling within the scope of the claims.

Some preferred uses of the invention relate to collection of recyclables and collection and disposal of organic materials, such as brush, leaves and moist garbage. The invention also can be used effectively, and with more advantages and benefits over the prior art, with respect to collection and disposal of these materials, or with other waste materials that contain a high percentage of liquids.

In the attached drawings, FIGS. 1-7 depict various embodiments of the invention for use with freestanding or stationary waste compaction systems. FIGS. 8-12 depict various embodiments of the invention when used on, or with, front loading waste collection vehicles (often called "garbage trucks"). FIGS. 13A-13B and 14A-14B depict embodiments using the present invention in connection with trailers or truck beds. FIGS. 15A-15C depict an embodiment with multiple compartments and including a hinged door or partition to separate the load materials and allow separate unloading of each compartment.

The term "waste materials" and "trash materials" will be used synonymously herein, and includes recyclable materials. These terms also are to be interpreted in their broadest sense and encompass all types of materials that are intended to be discarded and/or disposed of. Waste and trash materials, for example, include, but are not limited to, paper materials, wood materials, cardboard materials, glass items or materials, plastic items or materials, metal items or materials, organic materials, lawn and forest materials, and the like. The waste/trash materials can be materials which can be recycled. The materials further can be dry or have a significant fluid content.

Figure 1:
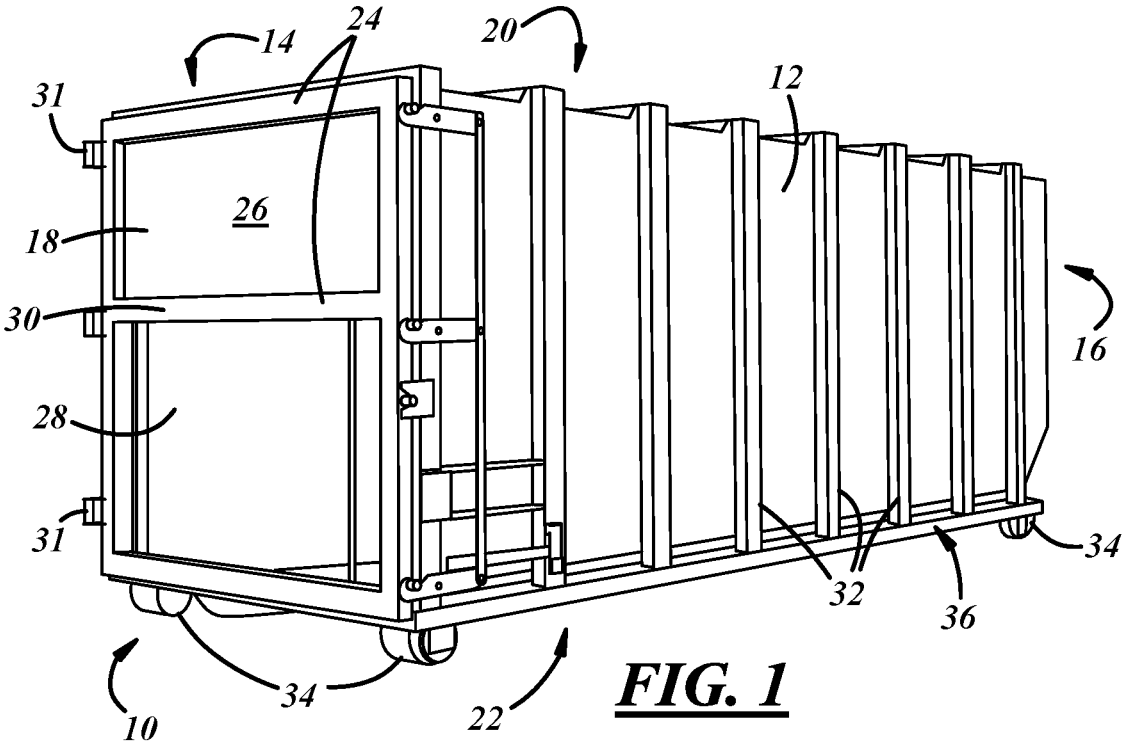
FIG. 1 depicts a freestanding waste container.

FIG. 1 depicts a typical known waste compaction container 10. This container is meant to be representative of all of the various types, sizes, and styles of waste compaction containers (some called "closed top boxes") that either are in existence at the present time, or may come into existence in the future.

The container 10 is used to hold waste materials of all types. The container has two sidewalls 12 and 14, two end walls 16 and 18, a top wall 20 and a bottom wall 22. For purposes of description in this document, the "front" end of the waste container will be the end that faces the cab of a truck when the container is mounted on a truck or on the bed of a truck or faces a vehicle which is pulling the container. The other end will be called the "rear" or "back" end. In FIG. 1, the front end is at wall 26 and the back end is at wall 18.

The container 10 is preferably made of a strong and durable metal material, such as steel. As shown in FIG. 1, the container has a hinged door member 30 at the rear end wall 18. The door has a frame member 24 that is the same size as the end wall opening, although a partial or "half-door" could also be provided. The frame member has a solid upper portion 26 and lower portion 28 which is open to allow entry or unloading of waste materials. The door member 18 is hinged at one side by hinge members 31 so the entire end wall can be opened for emptying or dumping of the collected waste materials inside the container 10.

Some embodiments of the container 10 also can have an opening (not shown in FIG. 1, but shown in FIGS. 2-6) in the upper wall 20. The opening can be used in some instances to introduce waste materials into the container and typically has a door or cover member (not shown) to selectively close or cover the opening. With this embodiment, the lower portion 28 as shown in FIG. 1 can be solid and not open. Also, the container 10 typically has a plurality of reinforcement members 32 on at least the side walls 12, 14 to add strength and durability, although this is not critical and may not be needed with some containers. Similarly, the size and type of door, as well as the existence of a door frame, can be different.

Further, a plurality of wheels 34 or skid members (not shown) are positioned on the bottom corners of the container 10, as well as a pair of lower side rails 36. These allow the container 10 to be more easily loaded and unloaded from a delivery vehicle. In use, empty containers are typically dropped off at a collection site and then picked up and emptied when they are full. The contents are typically emptied at a landfill or other dump site.

Waste collection containers, such as representative container 10, are typically utilized with a stationary compactor mechanism or device (not shown). The compactor mechanism receives waste and trash materials and typically compacts them and pushes them into the container through, for example, the opening in the lower portion 28 of the frame member 24 in door member 18. In some instances, as discussed in more detail below, the compactor mechanism is positioned interiorly or exteriorly to a building and receives the waste materials from a chute. Some compactor mechanisms also can pre-crush the materials in the compactor chamber as a first step and then push the crushed material into a container.

The present invention provides a waste container which incorporates a unique and different compaction system. The compaction system includes a compactor blade which is positioned and reciprocates in the upper areas of the containers above the floor, leaving a space between the blade and the floor. The compaction system is preferably hydraulically operated. For shorthand purposes of the present description of the invention, the waste collection container in accordance with the present invention will be simply called by the term "waste container" or "compacting waste container" herein.

Figure 2:
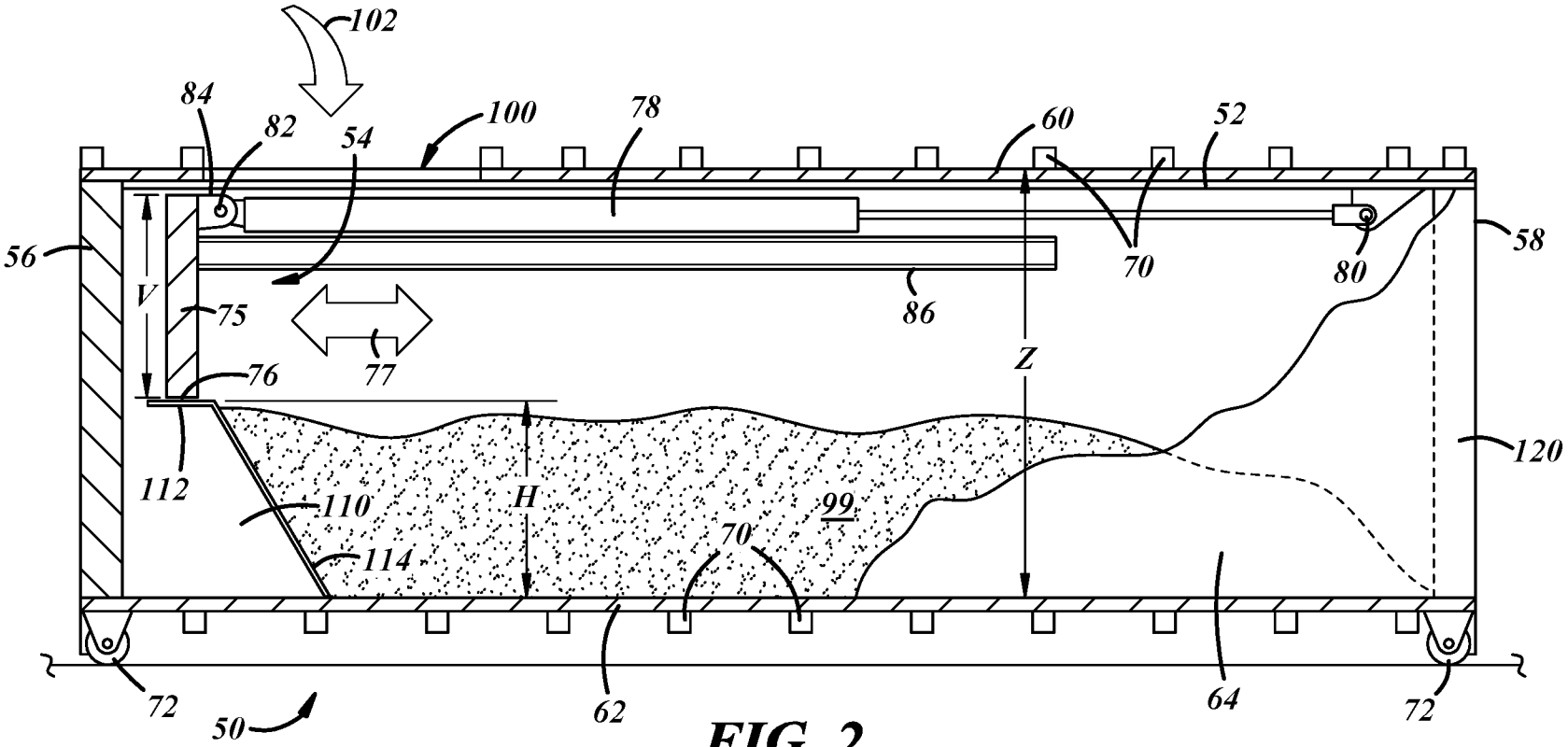
FIG. 2 depicts a preferred embodiment of the invention.

One embodiment of the invention is depicted in FIG. 2. It is generally designed by the reference number 50 and includes a box-type container 52 and a compactor mechanism 54. The container structure itself is similar in many respects to the one described above with reference to FIG. 1. The container 52 has a front wall 56, a rear wall 58, an upper wall 60, a lower wall 62, and a pair of side walls 64 and 66. The container 52 is preferably made from a strong metal material, such as steel, may include a plurality of reinforcing members 70 and a plurality of wheels 72.

A compactor blade 75 which is preferably hydraulically operated, can reciprocate back and forth substantially along the longitudinal length of the container—as shown by arrow 77. The blade 75 preferably extends horizontally between the side walls 64, 66 (with a small clearance). A pair of hydraulic cylinder members 78 are provided (only one of which is shown in FIG. 2) to move the blade 75 in the container. In the embodiment shown in FIG. 2, the blade 75 is moved longitudinally back and forth in the container in order to distribute and compact waste materials. An alternate hydraulic system could be provided which could only pull or push the blade and materials in the container in one direction to achieve the same purpose. The compactor blade itself is preferably made of a strong and sturdy material, such as metal (steel).

The hydraulic cylinders are attached at one end 80 to the container and at the other end 82 to the compactor blade or vice versa. A pair of brackets 84 is provided on the blade for this purpose.

Figure 3A:
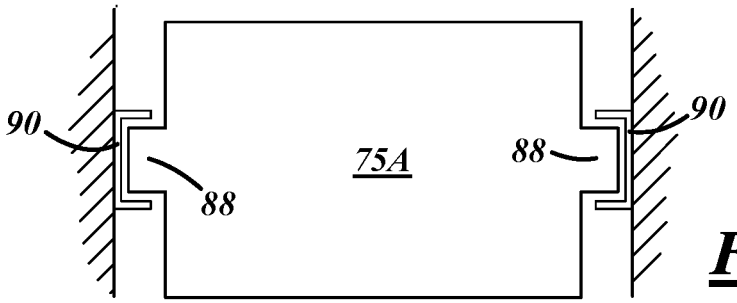
FIGS. 3A and 3B depict alternate embodiments for guiding a compactor blade in a container.
Figure 3B:
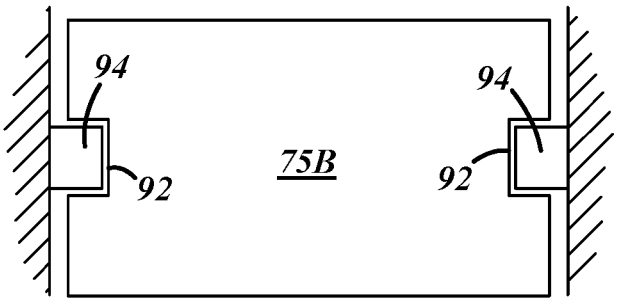

The blade is preferably made of a metal material and can be a solid structure or a thinner structure backed by supporting reinforcing members. The blade 75 is preferably guided along the length of the container by channels 86 or equivalent guide members. In this regard, two alternative exemplary ways to guide the movement of the blade in the container are shown in FIGS. 3A and 3B. In FIG. 3A, the blade 75A has two projections 88 which are guided in U-channels 90 at the sidewalls of the container. In FIG. 3B, the blade 75B has grooves 92 on its side edges which are positioned between and guided by guide rail member 94 on the side walls of the container. There are numerous other ways for the compactor blade to be guided along the length of the container, such as, for example, guide rails or channels on the top wall. With any of the guiding systems, it is preferred that a clearance of about 0.5"-1.0" is maintained between the compactor blade and the walls of the container. More clearance can be needed if the container walls are tapered. In the preferred embodiment, the interaction of the guide rails and mating compaction blade guide means allow the blade to "float" between the guide rails as it travels back and forth inside of the container.

The raised compactor blade can alternatively be attached to a carriage or frame which guides the blade along the length of its stroke in the container. The carriage can be designed to distribute any large twisting and movement loads into guide channels or guide rails.

The container 52 has at least one opening 100 on the top wall 60. Preferably with this embodiment, the top wall opening 100 is positioned adjacent to the front wall 56. This allows the blade 75 to push, redistribute and compact the materials as it proceeds in the direction towards the rear or back wall 58. The trash and waste materials are inserted into the hollow unitary volume inside the container through the opening 100. This is shown by arrow 102. A cover member (not shown) can be provided to cover the opening 100. A door member 120, which preferably is a hinged door member, is provided in the back wall for removal or dumping of the materials from the container.

The hydraulic mechanism used to actuate the compactor blade 75 can be positioned at any location inside or outside the container 52. The hydraulic mechanism also could be a separate unit connected to the container with hoses, cables, or the like. In the embodiment shown in FIG. 2, the hydraulic operating mechanism is located in compartment 110 at the front of the container. In alternate embodiments, the hydraulic operating and control mechanism could be positioned at other places in or on the container, such as, for example, outside on the front wall. The compartment 110 has an upper surface 112 adjacent the lower edge 76 of the compactor blade 75 and a front wall 114. The front wall 114 can be slanted as shown in FIG. 2.

When the trash and other waste materials are introduced into the container 52, the compactor blade 75 is activated and is used to push the materials toward the rear wall 58 of the container. The heavier and more dense materials will fall by gravity toward the bottom wall or floor of the container and the blade will level out the materials along the container. The movement of the blade also compacts the materials below the blade by pressure through the other materials. Any materials which remain above the lower edge 76 of the blade can be compacted against the rear wall 58 of the container. The blade also can level out or help compact the lower level materials when the blade is being retracted to its start (rest) position. Movement of the compactor blade back and forth several times along its length of trash assists in redistributing and densifying the waste materials. The waste materials are identified by 99 in FIG. 2.

When the container 52 is full, it is transported to a dumpsite or land fill and dumped, ejected or otherwise unloaded in a similar manner as set forth above with reference to FIG. 1. As indicated, a door member 120 is provided at the rear wall 58 for this purpose.

As indicated, preferably the compactor blade 75 is located at its rest position at the front end of the container (adjacent opening 100). The power unit which operates the blade includes an electric motor, hydraulic pump and hydraulic fluid reservoir, and is a self-contained system. A water tight seal is provided around the compartment 110 to prevent wet or semi-liquid waste materials from affecting the operation of the power unit.

The specific type of hydraulic mechanism utilized to reciprocate the compactor blade and level and compact the waste materials in the container is not critical. Most of the known hydraulic mechanisms in use today for the stationary waste compactors could be utilized. In addition, the hydraulic cylinders could be positioned behind the compactor blade and include a "scissor"-type mechanism.

As the material in the container increases in volume, the more the materials 99 will settle and migrate downwardly, and become compacted in the area below the lower edge 76 of the compactor blade. Any materials which stick up after the blade passes will be leveled or compacted as the blade travels in the opposite direction, or back-and-forth several times.

With the present invention, the amount of material that can be compacted and loaded inside the container is more than the amount that can be loaded and compacted into collection containers known today. Due to the top loading and raised compaction blade, the trash materials act in a manner more like fluid dynamics in filling the container volume to a greater extent. The amount of voids and open areas are decreased with the invention. Redistribution of materials of different densities can be achieved by continued movement of the raised blade. Also, the amount of "fall back" of the materials in the container that are compressed is less than with known compaction systems. This means that there is less "de-densifying" of the materials in a collection container with use of the present invention. It is believed that the use of a raised floor at one end of the container, such as wall 114 of compartment 110 in FIG. 2, may assist in preventing such "de-densifying." Wall 114 may be vertical or at an angle nearly vertical as shown in FIG. 2.

As indicated, the compactor blade 75 is positioned only in the upper or raised elevations or areas of the space in the container 52. The blade 75 has a vertical dimension V which at its lower edge 76 is 20-80% of the height H of the inside of the container as measured from the top wall 60 toward the bottom wall 62. This means that the lower edge 76 of the blade is preferably spaced from the bottom wall an amount of 20-80% of the total height Z inside the container. Preferably, the lower edge is at a height H less than 50% of the overall height Z of the container and within the range of 30-60% of Z measured from the upper wall 60. The height V of the blade can also be changed depending on the waste materials that are to be loaded into the container. Typically, the heavier and more dense are the waste materials, the less is the distance V. Similarly, with lighter and less dense materials, the distance H can be increased.

The compactor blade 75 can be actuated by any conventional hydraulic compactor mechanism or system so long as it can move the blade along at least a portion of the container and compact waste materials against the rear wall. In some embodiments, it may be necessary to only have the raised blade travel about one-third to one-half the longitudinal length of the container. Other embodiments may require the blade to travel substantially the entire length of the container. One or more hydraulic mechanisms or cylinders can be used to either push or pull the compactor blade longitudinally inside the container.

It is understood that the travel of the blade inside the container can be for any portion of the length of the container from about 10-100%. The length of travel depends in part on the type of waste materials being collected. In most instances, the length of travel of the blade can be 25-75% of the length of the container, and preferably 30-70%. The longitudinal length of travel of the blade may also depend on the size and length of the hydraulic cylinders utilized.

In general, the guide rail members can have slots or tracks in them and the blade member can have corresponding fingers, appendages, protrusions, or the like which fit and slide in or on the slots or tracks. In other embodiments, sets of two guide rails are provided and can be spaced a certain distance apart, such as 6"-12." With these embodiments, the side edges of the compactor blade preferably have one or more protrusions or raised members which fit between pairs of guide rails (as shown in FIG. 3A). The distance between the guide rail members can allow the blade members to float between them and thereby be prevented from sticking or jamming. If the inside surfaces of the side walls are tapered from the vertical intervention, as with some of the containers today, additional clearance will need to be maintained between the blade and the side walls. In addition, the side edges of the blade can be angled corresponding to the angle of the sidewalls.

Figure 4:
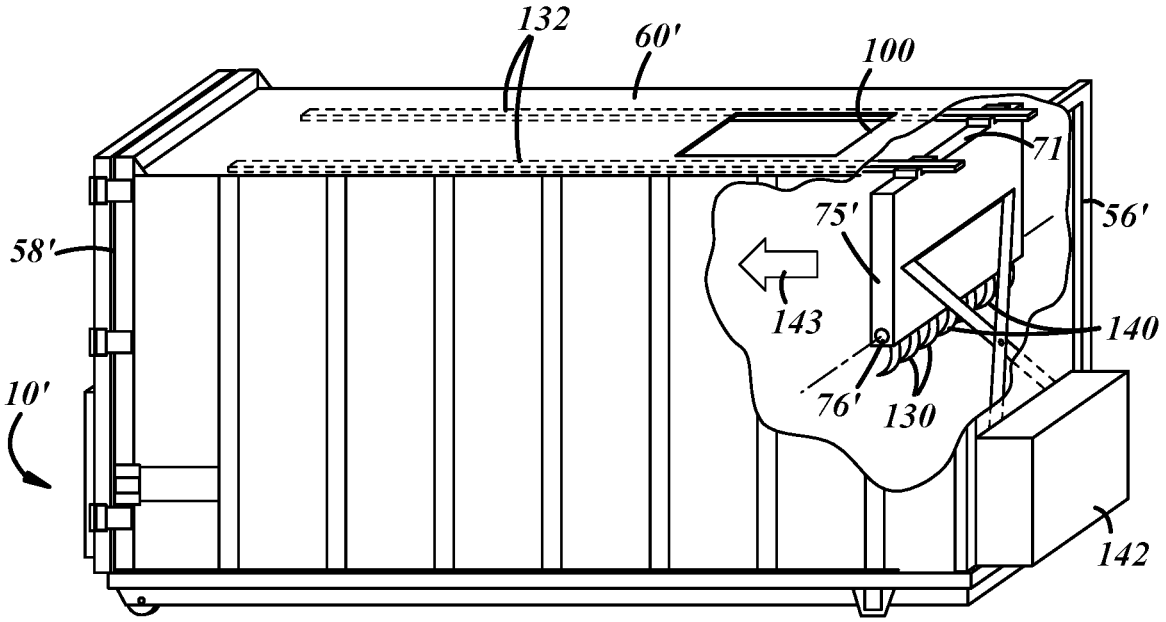
FIGS. 4 and 5 illustrate alternate embodiments of the invention.

In an additional embodiment, a plurality of rotatable or pivotable claw members 130 (or finger members) can be positioned extending downwardly on the lower edge 76' of the compactor blade 75'. This is shown in FIG. 4. In use, the claw members 130 assist in moving and spreading waste materials as the blade moves in a direction toward the rear end 58' of the container 10'. When the blade is returned to its rest position and moving in the opposite direction, the claw members rotate upward toward the front of the blade and thus pass easily over the waste materials. As an alternative to claw members, an elongated panel member can be pivotable or rotatably secured to the bottom edge of the compactor blade. The panel member is fixedly secured in position as the blade moves in its primary direction, but can pivot and rotate upwardly on the return stroke of the blade. The panel member can assist in providing a downward compaction force on the waste materials as the blade progresses.

FIG. 4 also depicts an embodiment of the invention in which guide rails 132 for guiding the blade 75 are positioned on the top wall member 60'. The guide rails are slidingly attached to the upper edge 71 of the blade 75'. In addition, the optional use of a "scissor"-type hydraulic mechanism 140 to move the blade 75' in the container 10' is depicted in FIG. 4. The power unit and mechanism for operating the hydraulic mechanism is positioned at 142 at the front end 56' of the container, which is preferable, but not mandatory. In this FIG. 4, the "scissor-" type mechanism is shown schematically. In actual use, the scissor action will extend and collapse along the longitudinal axis of travel of the compactor blade. This is shown by arrow 143. Opening 100 is provided for entry of wait materials into the container. Preferably, the opening is adjacent the blade 75'.

As indicated above, the heavier and more dense waste materials will fall or gravitate due to their weight or structure into the lower levels of the waste materials. The lighter and less dense materials will typically stay on top. Thus, with many of the strokes of the compactor blade, the principal materials that will be compressed either against the rear wall or against the lower wall and earlier compacted waste materials, are the lighter and less dense materials. This means that such strokes will result in less "wear and tear" on the floor of the container, as well as on the blade and hydraulic system. This would also result in the use of less energy. This also means that voids and open spaces in the trash materials are more likely to be filled in.

As the compactor blade returns to its rest position adjacent an end wall of the container, any materials which are still higher than the bottom edge of the blade, or which "pop up" after the blade passes them, will be leveled or pushed into the space against the rear wall on the subsequent strokes of the compactor blade.

With the present invention, that the fill volume in the container will be greater than with compaction systems or mechanisms which utilize short compaction blades positioned on the floor of the containers, or with full height compaction blades that extend from the floor to the upper wall. Also, the amount of voids or free space left unfilled in the container when it appears to be full and needs to be emptied, will be less with the present invention.

Figure 5:
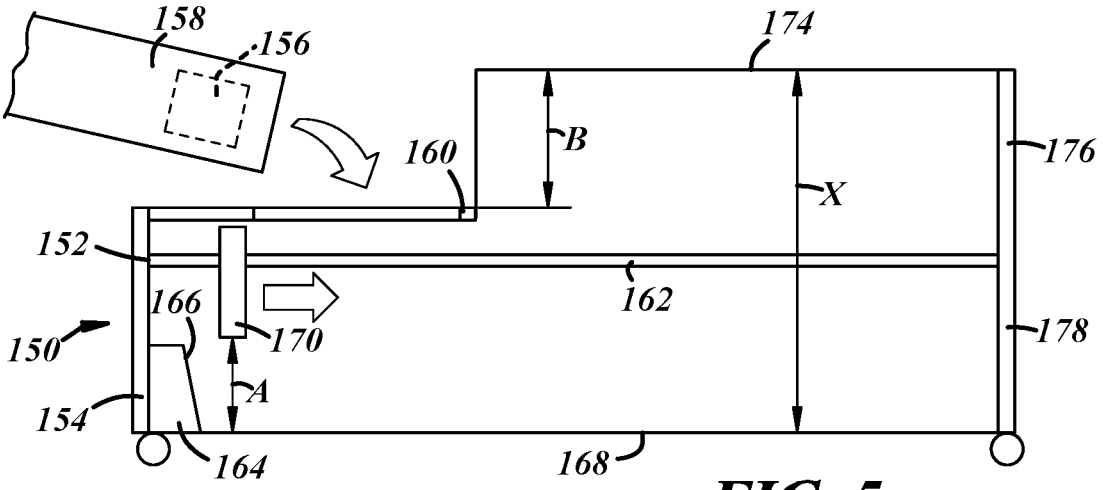

An alternate embodiment of the invention is disclosed in FIG. 5 and referred to generally by the reference numeral 150. The container 152 has a lowered front end wall 154 and is used to collect trash and other waste materials 156 which are supplied from above, such as by a chute member 158 attached to a building or other structure (not shown). Waste chutes of this type are in common use today. With these known systems, a separate fixed stationary compactor mechanism (not shown) is typically positioned below the end of the chute and outside the container 152. The compactor mechanism slides the waste materials into the collection container and compacts the materials inside the container 152.

With the embodiment of the invention depicted in FIG. 5, however, the use of a stationary compactor mechanism is unnecessary. The chute 158 can drop the waste materials 156 directly into the container 152 in front of the compactor blade 170. An opening 160 is provided for this purpose. The compactor blade member 170 is provided inside the container 152 and guided by, for example, one or more guide rails 162. The blade member 170 is operated by a hydraulic power unit 164 positioned in compartment 166 inside the container. The power unit can also be positioned at other locations inside or outside of the container. For example, the type, contents and position of the hydraulic power unit and hydraulic mechanism used to operate the compactor blade can be any of the embodiments set forth herein or any other type known in the art.

The size of the opening 160 can depend in part on the size of the waste materials being compacted. Typically the openings extend substantially across the width of the container, and extend in the longitudinal direction of the container. The present invention opening can be considerably larger in both width and length dimensions. The width may be 70 inches wide versus 60 inches with known containers today, and the length not limited to the catalog sizes of conventional compactors of 42 inches and 60 inches, but only limited to one-half the travel of the waste container longitudinal length. The nominal length of a conventional waste collection container is 22 feet.

As shown in FIG. 5, the compactor blade 170 is positioned a distance "A" above the bottom floor 168 of the container. Also, due to the lowered front end of the container 152, the blade is also positioned a distance "B" from the upper wall 174 of the container. A door member 176 for emptying the container is provided at the rear wall 178 of the container.

The distances "A" and "B" are dependent on the size of the container and the amount that the front end of the container has been lowered to be able to receive waste materials from a chute member or the like. In general, the distance "A" should be 30-50% of "X", which is the height of the container at the opposite end. Also, the distance "B" should be about 20-30% of the height "X".

Figure 6A:
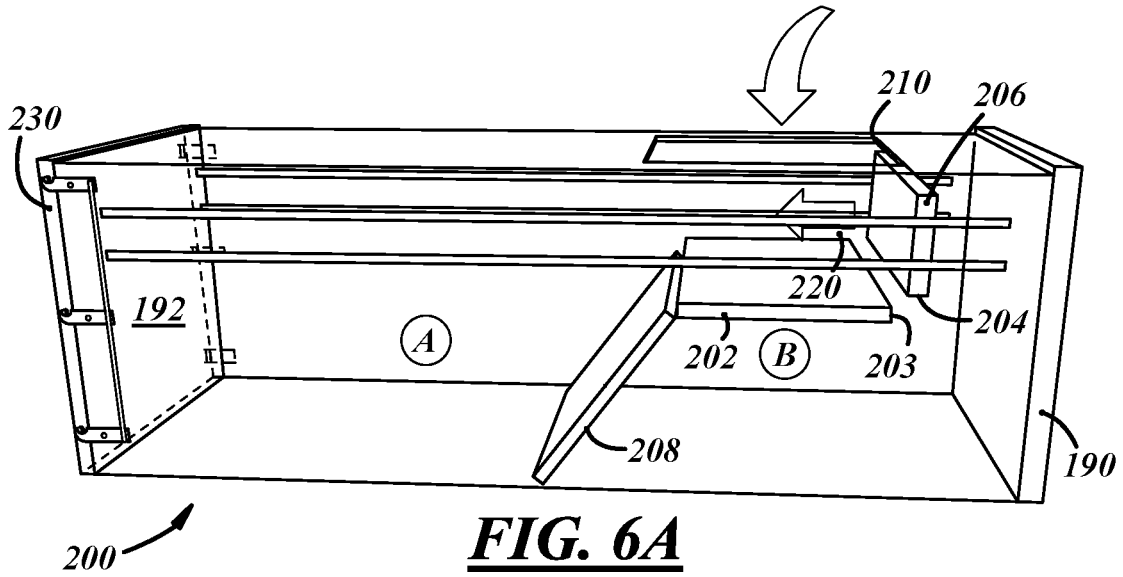
FIGS. 6A and 6B schematically depict a two-compartment embodiment of the invention.
Figure 6B:
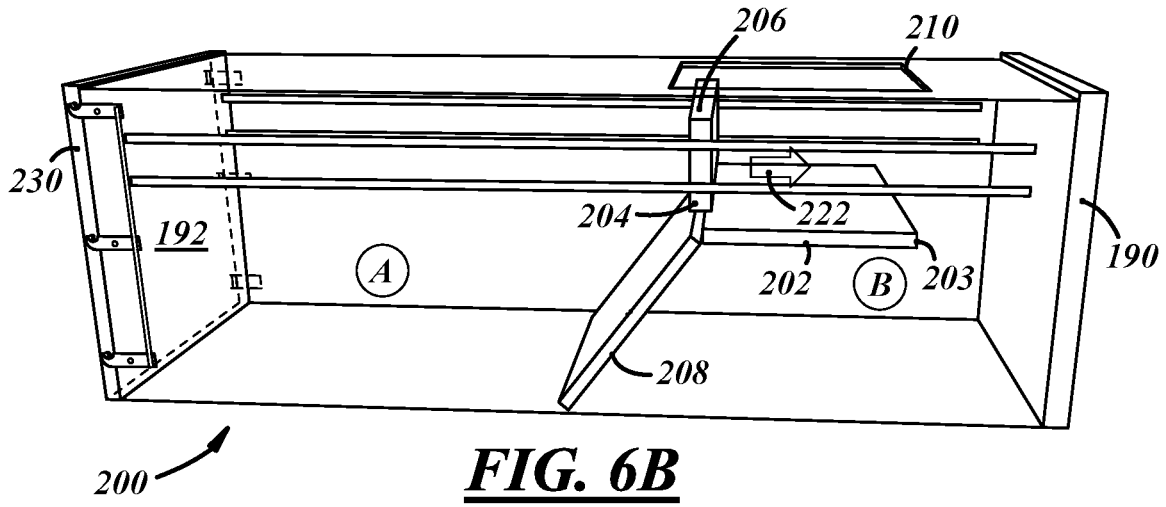

It is also possible with other embodiments of the invention to provide two or more separate areas in a container for collection of separate types of materials, such as waste and recyclables, or two different types of recyclables (e.g., plastic and metals). One such embodiment is shown in FIGS. 6A and 6B. In this embodiment 200, a platform or shelf member 202 is positioned in the container 190 at a height adjacent the lower edge 204 of the compactor blade member 206. The platform 202 is preferably located under opening 210. The platform 202 has a hinged portion 208 which in the lowered position shown in FIG. 6A divides the space inside in the container into two separate areas A and B. In an alternate embodiment, the edge 203 of the platform 202 could terminate about half the length of the opening 210 allowing material to free fall into area B.

With this embodiment of the invention, the waste collection container can be used to collect two different types of waste materials, such as organic material on one side and metal or plastic materials on the other side, or as waste materials on one side and recyclable materials on the other side. This saves use of two separate vehicles traveling along the same route in order to pick up separate materials and also saves the expense and footprint of two separate waste containers.

In order to direct the waste materials into area A, the compactor blade 206 is used in the standard manner as discussed above. The materials are introduced into the opening 210 in FIG. 6A and pushed into area A by movement of the blade member 206 in the direction of arrow 220. Then, when it is desired to introduce materials into area B, the blade member 206 is first moved to the position shown in FIG. 6B. Then, when the second type of material is introduced into the container through opening 210, the blade member 206 is moved in the direction of arrow 222 to push the materials into area B. It is also possible to position the compactor blade mid-way in the opening so that different types of materials can be separately introduced (typically manually) into areas A and B without having to move the blade as frequently. The expected amounts of A-type materials and B-type materials can determine the placement of the top wall opening, the platform, and the rest position of the compactor blade.

When it is desired to empty the container 190, a hinged door member 230 is provided at the rear end wall 192 for this purpose. After the materials in portion A are emptied, then the hinged shelf portion 208 is raised and the materials in portion B can be emptied out of the same door member. In this regard, the typical manner in which waste collection containers are emptied is to raise one end of the container and let the materials fall out the door at the other end. The activation of the compactor blade can assist in ejecting or removing the materials from the container.

In another embodiment, separate door members can be provided at each end of the container in order to allow the collected materials to be removed from separate ends of the container.

Figure 7:
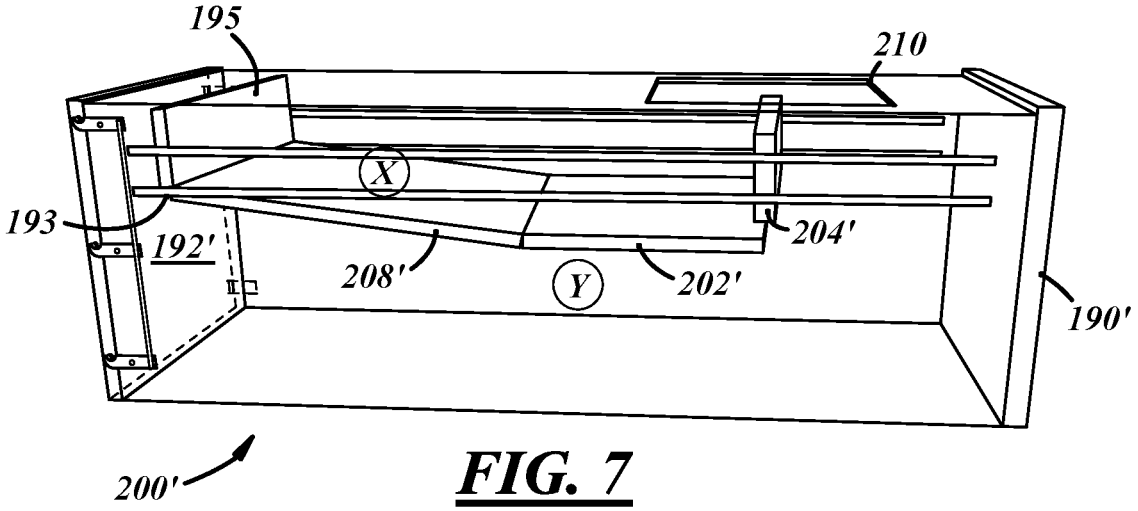
FIG. 7 illustrates another embodiment of the invention.

FIG. 7 illustrates a modification 200' of the embodiment shown in FIGS. 6A-6B. In FIG. 7, the portion 208' of the interior platform 202' is angled upwardly toward the end adjacent the rear wall 192' of the container 190'. The portion 208' is hinged to a stationary portion 202' of the platform. The end 193 of shelf portion 208' can be releasably attached to cross member 195. This embodiment forms separate collection areas X and Y and has particular use for collecting liquid-type food wastes in area Y, and collecting bottles, cans and/or other recyclables in area X. Area Y can be emptied first through end wall 192'. Thereafter, shelf portion 208' can be released from cross member 195 so the content of area X can be emptied.

An alternate embodiment of a multi-compartment waste/recyclable container 700 is shown in FIGS. 15A-15C. The container 700 has a top wall 702, a front wall 704, a bottom wall 706, a back or rear wall 708, and a pair of sidewalls 710 and 712 (only 710 being shown). A door member (not shown) is located in rear wall 708 for removal of the collected materials. A compactor blade 720 is positioned inside the container 700. An opening 722 is located in the top wall 702. Preferably the opening 722 is positioned about in the middle of the longitudinal length of the container 700. Also, preferably, the compactor blade has its "at rest" position under the opening 722.

A moveable partition, door or wall 230 is positioned inside the container 700 and separates the area inside the container into two separate compartments A and B. The door or partition 230 is connected (hinged) to one side wall, such as side wall 710, and extends across the width of the container between the sidewalls. In FIG. 15A, the partition wall 230 is positioned transverse to the longitudinal length of the container forming the separate A and B compartments. In this manner, materials, such as soda can recyclables 740 in compartment A and glass bottle recyclables 742 in compartment B, can be collected in the container 700 and kept separate. In FIG. 15B, the partition wall is shown rotated to its "open" position against sidewall 710. In FIG. 15B, the collected materials in compartment B (such as glass bottles 742) have been removed or dumped from the container.

The dumping of materials from the container 700 is shown generally in FIG. 15C. The container is tipped up as shown so that the materials can be dumped from the compartments, with the materials formerly in compartment B previously being removed, and with the materials 740 in compartment A being dumped as shown. Once all of the materials have been dumped, the partition or door is returned to its original position as shown in FIG. 15A.

The compactor blade 720 can be the same as, and operated in the same manner as, any of the compactor blades previously shown in FIGS. 1-4. Preferably a hydraulic mechanism as described above is utilized to move the blade back and forth longitudinally in the container, as shown by arrow 750. The blade is used to distribute and compact the materials in the compartments A and B. It is also preferable that the bottom edge 752 of the blade 720 is positioned adjacent (close to) the top edge 232 of the partition wall 230.

The edge 222 of the partition or wall 230 can be rotatably connected or hinged to the side wall 710 in any conventional manner. In addition, the opposite edge 224 of the partition or wall can be releasably connected to the opposite sidewall 712 in any conventional manner. Preferably a releasable latch mechanism is provided on the edge 224 or sidewall 712, or both, in order to hold the partition in the separation position shown in FIG. 15A.

When the partition is positioned in its "open" position as shown in FIG. 15B, it is preferable that it is aligned with the interior surface or side wall 710 in order to allow ease of evacuation of the materials.

It is also possible for the container 700 to have more than two compartments. For these embodiments, there will be two or more internal partitions or doors, and either one larger opening in the top wall or two or more openings in order to drop the waste or recyclable materials into the appropriate compartments in the container. This will also preferably require the compactor blade to be positioned appropriately for each of the materials being collected. For one or more of these embodiments, it also is possible to have doors at both ends of the container for ease of dumping or removal of the materials from the container.

In these collection container embodiments, one of which is shown in FIGS. 15A-15C, the vertical height 800 of the blade 720 is preferably 10-50% of the vertical height of the container from the bottom wall 706 to the top wall 702, as measured from the top wall vertically downward toward the bottom wall.

Figure 8:
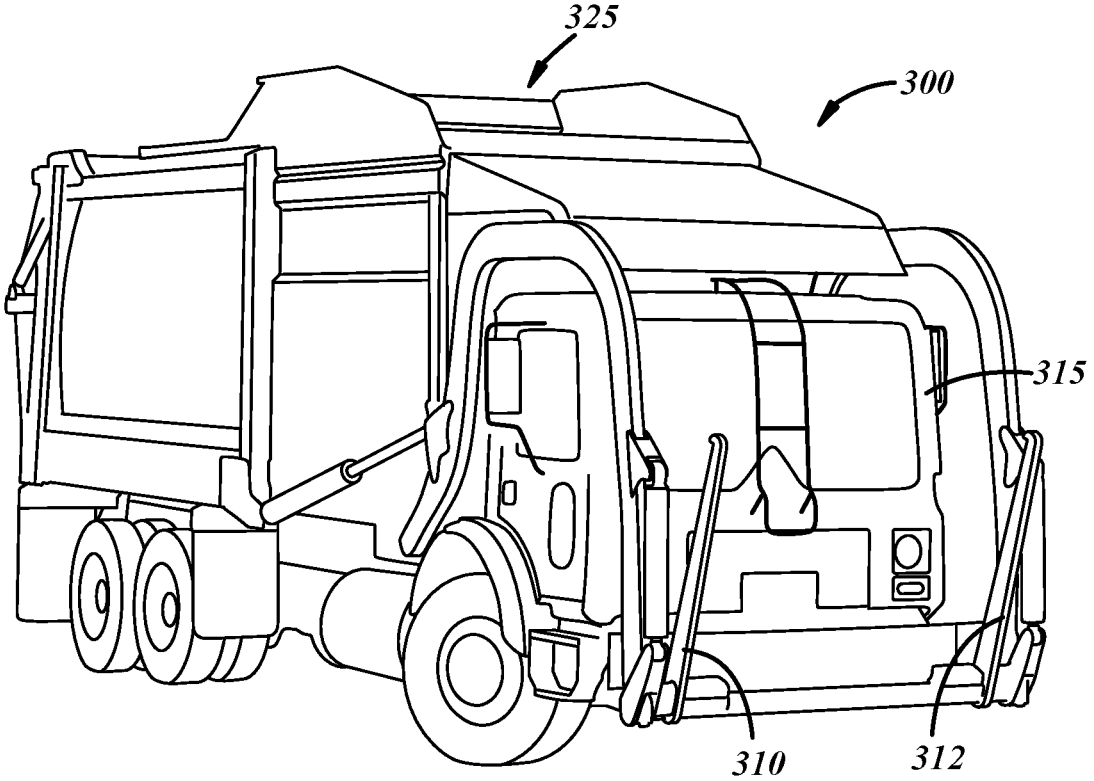
FIG. 8 depicts a perspective view of an exemplary front loading waste collection vehicle.
Figure 9:
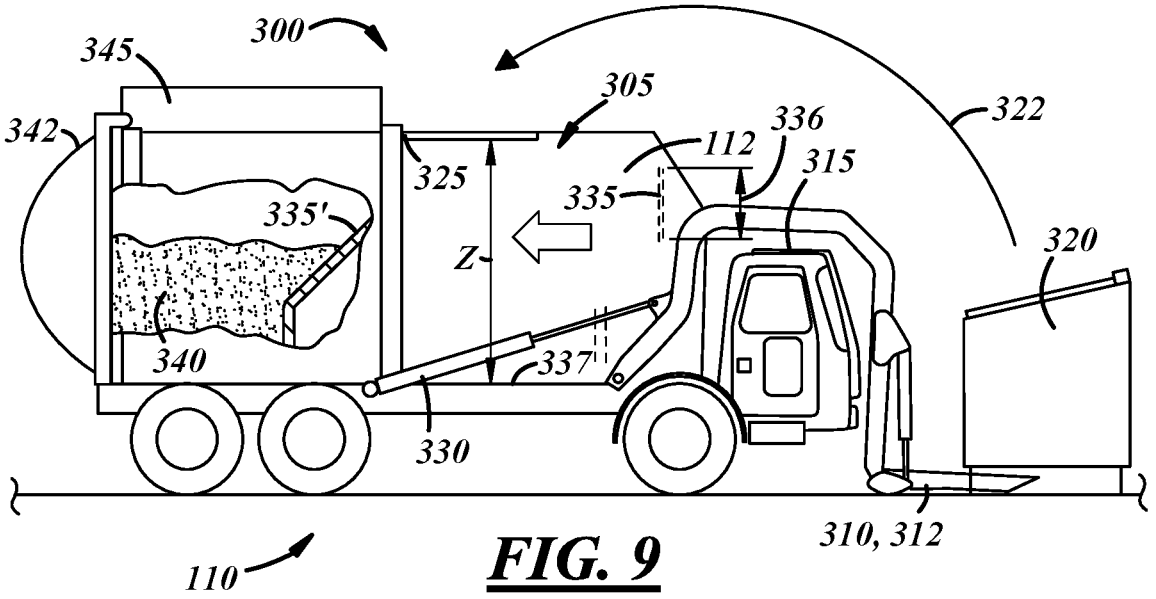
FIG. 9 depicts a side view of the waste collection vehicle in FIG. 8.
Figure 10:
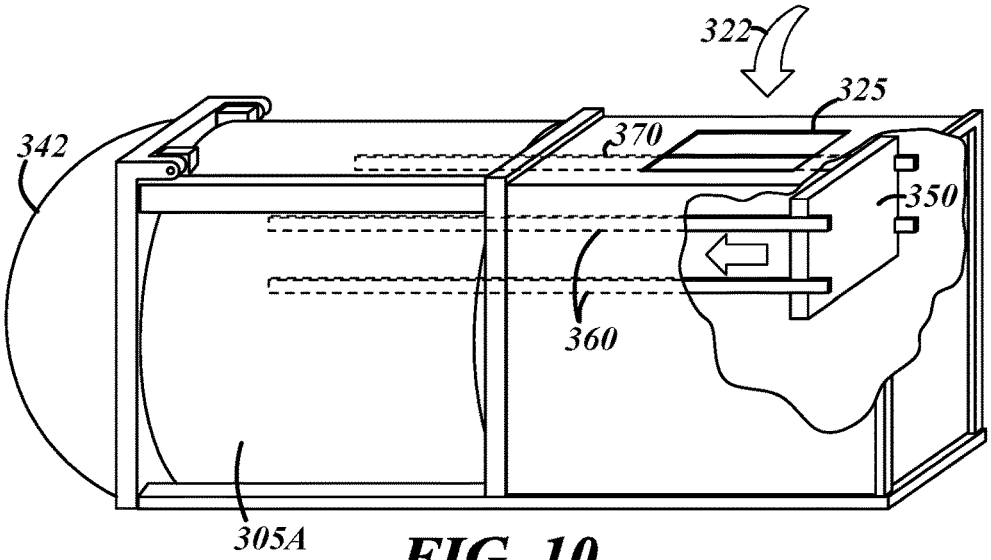
FIGS. 10, 11 and 12 illustrate embodiments of the present invention for use with waste collection vehicles.
Figure 11:
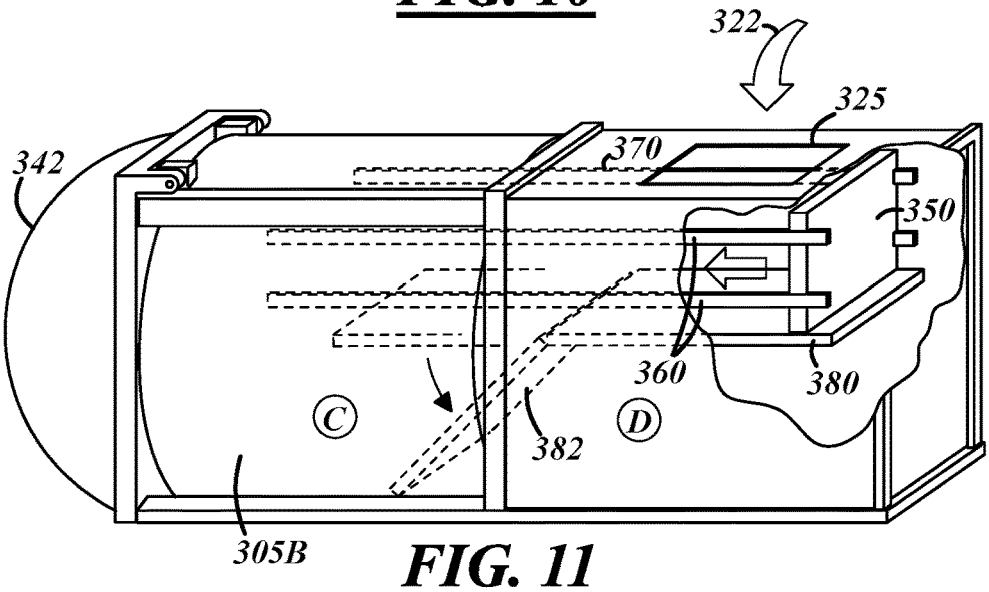
Figure 12:
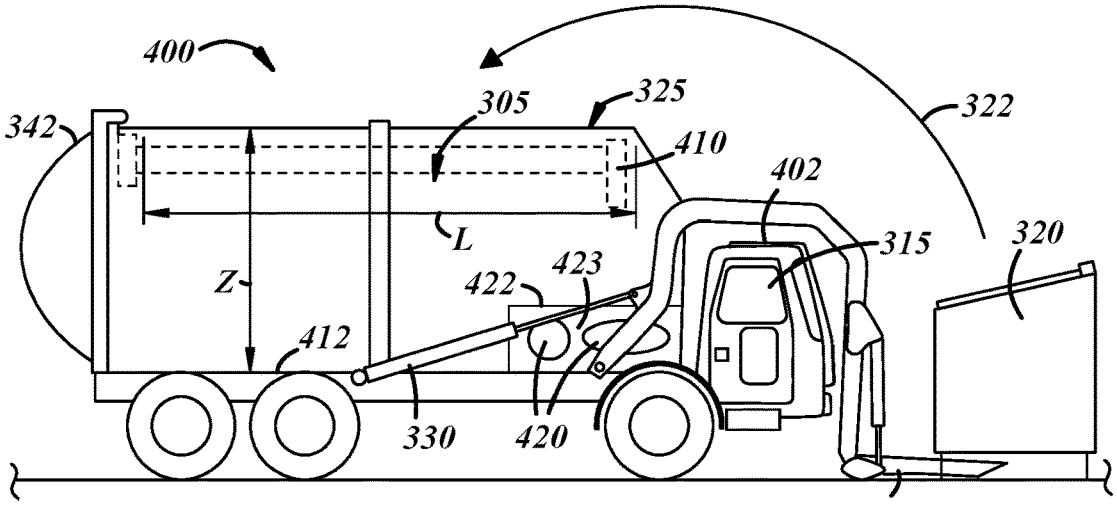

The use of the present invention in waste collection vehicles (a/k/a "garbage trucks") is shown in FIGS. 8-12. FIGS. 8, 9, and 12 illustrate a representative front-loading waste collection truck 300 or 400. The vehicle has a truck collection container 305 and a pair of hydraulic actuated lift arms 310, 312 that extend in the front of the cab 315. In use, the lift arms are used to pick up collection container, such as container 320 (typically smaller than the large containers discussed above), and lift them in accordance with the arrow 322 and dump the contents into an opening 325 in the top of the truck container 305. Hydraulic cylinders 330 are used to operate the lift arms.

The waste container 305 is a large collection vessel for compacting, storing, and transporting trash and other waste materials. A compactor blade 335 having a height 336 is positioned inside the container 305 and is hydraulically actuated to push the waste materials 340 in a direction toward the rear of the vehicle and compact the materials against the rear wall 342. This is in the manner similar to that described above with reference to FIG. 2. The compactor blade also can extend substantially the entire length L of the container (as shown in FIG. 12). The rear wall 342 is typically hinged in order to be opened to allow the collected trash materials to be ejected from the container.

It is also possible for the compactor blade to have the shape shown as number 335' in FIG. 9. The blade 335' is positioned directly on the floor 337 of the container for the materials and can travel the full length of the inside of the container.

The compactor blades 335 and 335' are preferably operated hydraulically. The hydraulic systems can be positioned at any convenient location on the vehicle. The engines for waste collection vehicles are typically diesel engines or engines that run on compressed natural gas (CNG). In CNG driven vehicles, the CNG tanks and systems are typically positioned in a compartment 345 positioned at the top of the vehicle adjacent the rear end as shown in FIG. 9. The positioning of the CNG components in a compartment, such as a compartment 345, on the top of the vehicle sometimes can cause problems during use of the vehicle for its purpose. The added height can cause unintentional damage to the compartment or system from obstacles such as low ceilings, trees, and other obstructions.

It is to be understood that the present invention is not to be limited to the use of hydraulic systems to move the compactor blade and compact the waste materials. Other systems could be used for this purpose.

FIGS. 10 and 11 schematically depict waste containers 305A and 305B for a waste collection vehicle, such as a front loading waste collection truck depicted in FIGS. 8 and 9. In use of the present invention in the containers in FIGS. 10 and 11, a compactor blade 350 is positioned inside the containers and raised above the floor, and positioned, guided and used in a similar manner to the compactor blades 75, 75A, 75B and 206 discussed above with respect to FIGS. 2-4 and 6A. A carriage or track rail system could also be used to guide the blade inside the vehicle's container. The compactor blades 350 are actuated by a hydraulic system in a similar push and/or pull manner discussed above and the blade is guided by guide rails such as 360 or 370 on the side walls or top wall, respectively, of the containers 305A, 305B, again in the same manner as discussed above. The manner of use and results achieved thereby of the invention in the containers is the same as the use and results discussed above with respect to the other embodiments of the invention.

The embodiment of the invention shown in FIG. 11 is similar to the embodiment discussed above with respect to FIGS. 6A-6B. The vehicle waste collection container 305B has a platform 380 which is positioned below the blade 350. The hinged portion 382 of the platform can be used to divide the inside of the container into two separate compartments C and D. Materials are dropped into the containers through opening 325, as shown by arrow 322. In this manner, one collection truck can be used in a neighborhood to collect both waste materials and recyclables.

Again, when it is desired to empty the two compartments C and D, the compartments are typically emptied separately. First, the materials in compartment C are emptied. Then, the hinged portion 382 is raised and the materials in compartment D are emptied. The trash collection containers are typically elevated like dump trucks in order to dump or unload the waste materials. The compaction blade can also be used to help eject the materials. Other systems could also be used to empty out the contents of a container, such as systems utilizing a manually operated "walking floor" apparatus.

An improvement in the location of CNG systems to operate a waste collection vehicle is possible with the present inventive raised compactor blade system. This is shown in FIG. 12 and indicated generally by the reference numeral 400. Components which are the same as the vehicle disclosed relative to FIG. 9 are indicated by the same reference numerals. The compactor blade 410 is positioned raised above the floor 412. The collection container 305 has a height "Z" and length "L". Waste materials poured into the top opening 325 of the container are redistributed, densified, and compacted by the blade 410 as it travels back and forth along the length L in the container. The materials in container 305 are emptied through hinged end 342 and by raising the container by hydraulic cylinders 330.

The floor 412 of the collection container 305 has a raised floor 422 positioned below the compactor blade and in the front of the container near the cab. The CNG cylinders and equipment 420 are positioned under the waste container formed by the raised floor 422. By positioning the CNG equipment under the waste container, rather than on top of the waste container, this prevents them from being damaged or interfering with the movement of the vehicle. The area 423 under raised floor 422 as a net gain of chassis additional space behind the cab. The area can be utilized for various engine and vehicle components and/or as room for the various electrical batteries requirements for the upcoming electric chassis for garbage trucks.

Figure 13A:
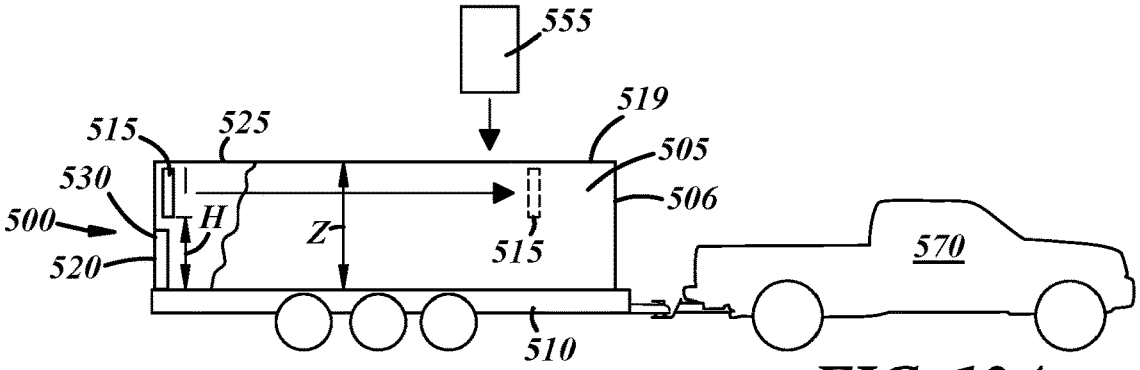
FIGS. 13A and 13B depict another preferred embodiment of the invention in which the container is positioned on a trailer.
Figure 13B:
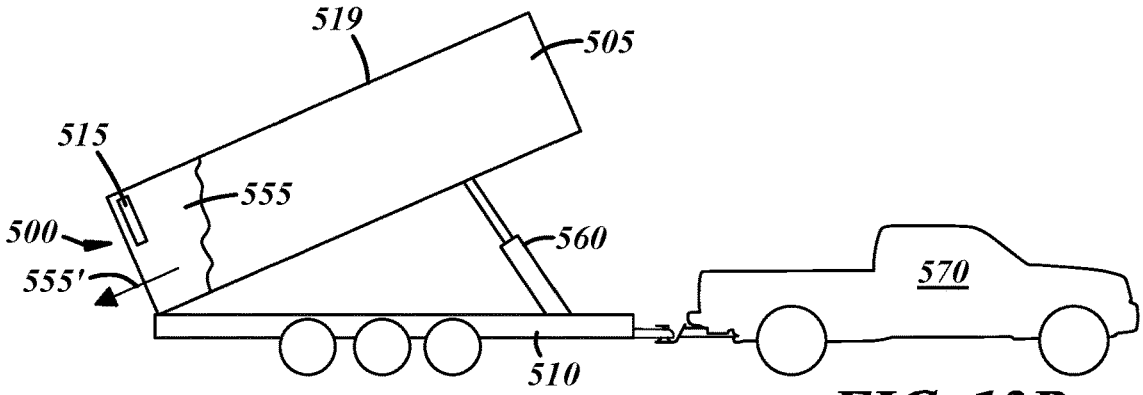
Figure 14A:
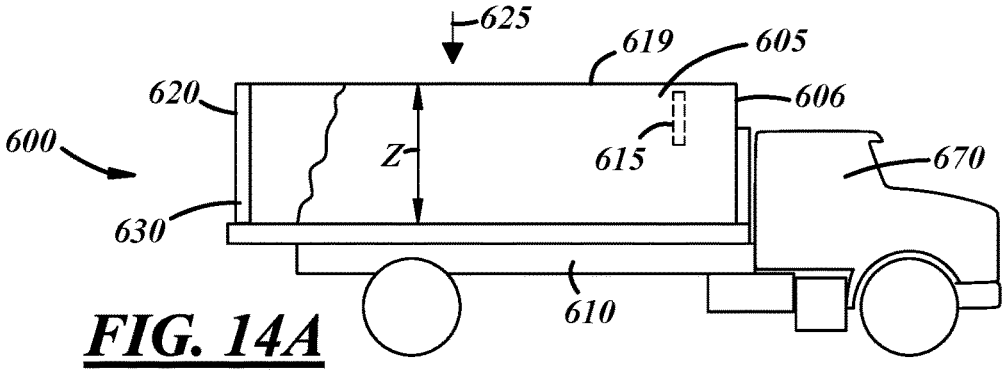
FIGS. 14A and 14B depict still another preferred embodiment of the invention with the container being positioned on the bed of a truck.
Figure 14B:
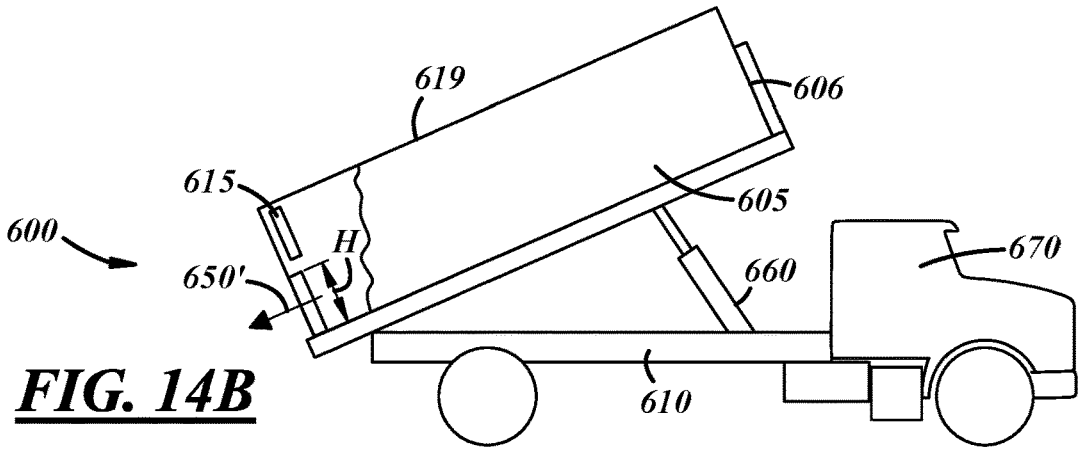
Figure 15A:
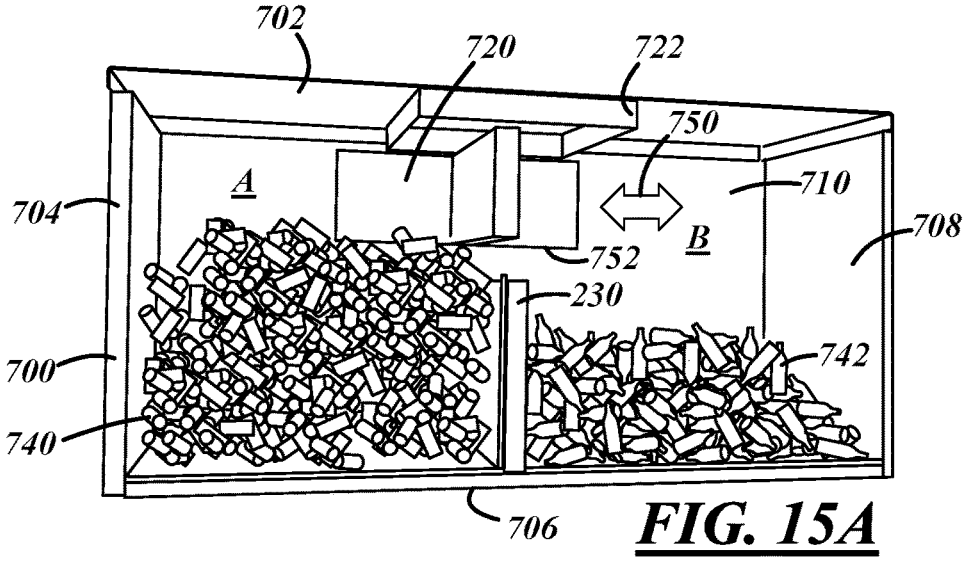
FIGS. 15A, 15B, and 15C depict a multi-compartment container with a hinged door or partition.
Figure 15B:
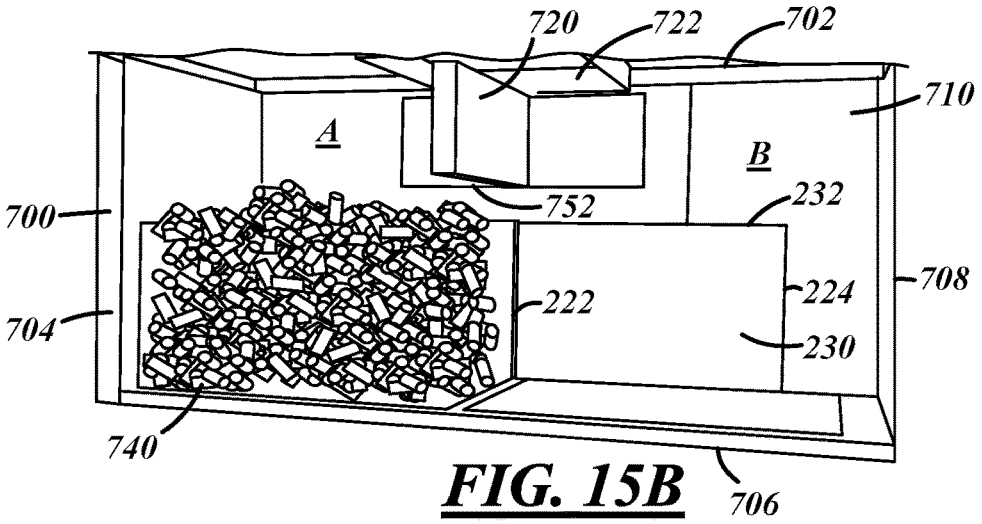
Figure 15C:
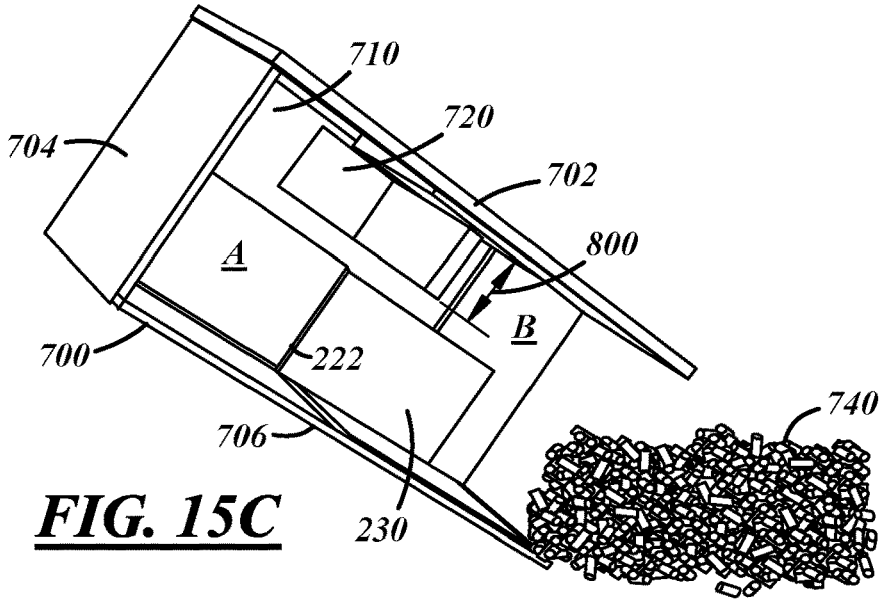

Additional embodiments of the present invention are first shown in FIGS. 13A-13B and secondly shown in FIGS. 14A-14B. In the first such embodiment 500, the waste container 505 is securely positioned in or on a trailer 510. The container discharge door 530 is in the rear wall 520. The top wall 519 contains top wall opening 525. The top wall opening 525 is located adjacent the rear wall 520 when the compactor blade 515 is at rest adjacent the rear wall. Alternatively, the top wall opening could be located adjacent the front wall 506 when the compactor blade is at a rest position 515' near the front wall. The container functions in substantially the same manner relative to the compactor blade member 75 in FIG. 2. If the compactor blade is positioned to operate from the front wall 506 longitudinally toward the rear wall 520, then the opening door 530 at the rear wall can be the same size as the rear wall. On the other hand, if the compactor blade is positioned to operate from the rear wall towards the front wall, then the rear door and opening should be smaller and positioned below the bottom edge of the blade. The location of the top wall opening 525 is preferably positioned such that the waste materials 555 are dumped or dropped into the container adjacent the rest position of the compactor blade. It is also possible, of course, to position the top wall opening anywhere as desired.

The blade member 515 has a height dimension H which is 20-80% of the full vertical height Z of the container 505 in the same manner as described above relative to other figures. The control and operation of the compactor blade are also preferably the same as, or similar to, the hydraulic systems set forth and described above.

In order to empty out the container 505, the container 505 is angled upwardly relative to the trailer 510 by one or more hydraulic cylinders, as represented by hydraulic cylinder 530 shown in FIG. 13B. This allows the waste materials 555 which are deposited in the container 505 to be emptied out from the container trash door 530 (as shown as 555'). The compactor blade can be operated to assist in emptying out the materials from the container.

The container 505 can be tipped or elevated into the position shown in FIG. 13B for emptying in any conventional manner. For example, in one embodiment, hydraulic arm member 560 powered by a hydraulic mechanism on the trailer 510 could be utilized. It also is possible for the end of the container to be hinged to the end of the trailer. It is further possible to remove the trailer from the vehicle and tip up the entire trailer and container in order to unload the container.

With this embodiment of the invention, the trailer could be attached to a pick-up truck, such as truck 570 or the like. This would allow the waste collection system to travel and be positioned in numerous locations which could not be serviced due to difficult urban space limitations. The invention would also be more efficient than a traditional waste container truck of the type shown in FIGS. 8, 9, and 12 and would provide service at a lower cost.

A second embodiment 600 shown in FIGS. 14A-14B is a variance of the embodiment shown in FIGS. 13A-13B. Here, the container is positioned on the bed or frame 610 of a truck 670. In this FIG. 14A second embodiment, the waste container 605 has a "full size" discharge door 630 is in the rear wall 620. The top wall 619 contains top wall opening 625. The top wall opening 625 may be located adjacent the rest position of the compactor blade 615 when the rest position is adjacent the cab of the truck 670.

The top wall opening 625 should be positioned at a rearward position on the top wall 619 which is adjacent to rear wall 620 when the compactor blade is positioned at rest adjacent to the rear wall.

The container and compactor blade function and operation are substantially the same manner as discussed above relative to other embodiments. In addition, preferably, the blade member 615 is positioned at a height dimension H of 20-50% of the full height Z of the container 605.

The vehicle 670 can have a hydraulically operated tilting mechanism 660 which, when activated, tips the container as shown in FIG. 14B for emptying. Alternatively, the vehicle can have a hydraulically operated tilting mechanism that tips the entire bed 610 of the truck in order to empty the contents of the container.

In the FIG. 14B embodiment, the door member is at the rear end of the container, and the waste container operates in the same manner and for the same use as embodiments described above. Thus, the waste materials loaded into the container 605 and compacted by the compactor blade 615 are emptied out at 650' through a door in the rear door.

In order to show the benefits and advantages of the present invention, comparison tests were made with representative scale models. The tests compared the payloads and weight of containers which were loaded with similar materials and which used the following three types of compaction blades: (1) a full blade; (2) a partial blade on the floor; and (3) a raised partial blade.

A one inch-per-foot model was constructed to reflect the mobile and stationary compactor applications. The conventional mobile and box-like compactor containers are normally 22 feet in length, 8 feet in height, and 8 feet in width. The scale model chamber was correspondingly made to be 22"×8"×8". The model had a wood box-type frame with an open space for loading materials at the upper end of the chamber adjacent the compactor blade.

The travel of the compaction blade was powered by an electric scissor-action device commonly used to power an automobile window. The electric motor was energized by a 12-volt automotive battery. A 12-volt battery charger was continuously utilized to maintain a constant charge in the battery.

The blades were all made of wood and attached to an elongated rod. Guide rails were used along the edge of the floor for blades (1) and (2). Mulch was used as the compaction material. The mulch was added to the containers during the tests in measured one liter units. The mulch was added and compacted in all of the tests in the same manner.

The model compaction chamber was placed on a digital scale in order to record the weight tests. The chamber was weighed before and after each test. Each test was run several times.

Full Blade Test:

The blade was 7½"×7½" and was connected to the elongated rod. The model was operated several times without anything in the chamber to make sure that the blade traveled smoothly from one end to the other. The mulch was added in measured units through the opening in the top surface. The blade was activated and the mulch compacted after each unit of mulch was loaded into the chamber.

Floor Blade Test:

The blade was 4" in height and 7½" in width. The blade rested on and traveled along the floor. It was guided by guide rails positioned at the bottom corner of each of the side walls.

Raised Blade Test:

This test incorporated the invention. The blade was 3" in height and 7½" in width. The top edge of the blade was positioned immediately adjacent the top wall and the bottom edge of the blade was spaced about 5" from the floor of the chamber. The movement of the blade along the chamber was guided by guide rails positioned on the upper edges of the side walls adjacent the top wall.

Test Results:

The mulch was added in the same liter units during each test, and the compaction blade operated and the material compacted in the same manner until it was not possible to add any additional mulch. The number of measured units of mulch was recorded for each of the four tests for each type of blade, and the four amounts averaged. The weight of the compactor chambers was also taken after each test and the amounts were averaged. The results are shown in the following chart:

| | Units Added | Average Units Added | Weight | Average Full Weights |
|---|---|---|---|---|
| Full Blade | 19.5, 18, 18, 18 | 18.38 | 5.3, 4.4, 4.8, 3.8 | 4.76 |
| Floor Blade | 13, 13, 13, 13 | 13 | 4.4, 4.2, 4.4, 4.4 | 4.35 |
| Raised Blade | 22.5, 22, 23, 20.5 | 22 | 6.9, 7.1, 7.3, 7.1 | 7.1 |

As evidenced, the model representing the present invention was able to compact 20% more of the waste materials than the full blade embodiment and 69% more than the floor blade embodiment. In addition, the average weight of the compacted loads was 49% and 63% greater with the partial (raised) blade than the full blade and floor blade embodiments, respectfully.

The results of these tests showed that the present invention with use of a raised compactor blade resulted in filling the waste containers with 20% to 69% more of the waste materials and a load which was 49% to 63% heavier. Thus, the use of the present invention would result in substantial savings of time, money and labor in the collection of waste materials.

Although the invention has been described with respect to preferred embodiments, it is to be also understood that it is not to be so limited since changes and modifications can be made therein which are within the full scope of this invention as detailed by the following claims.

What is claimed is:

1. A compacting waste container comprising:

a container having a front wall, a rear wall, two sidewalls, a bottom wall, and a top wall with at least one opening therein for entry of waste materials;

said front wall, rear wall, side walls, top wall and bottom wall forming a single cavity for collection of waste materials;

said single cavity having a height between said bottom wall and said top wall;

a compactor blade positioned in said single cavity and having an upper edge and a lower edge disposed in spaced relationship with said bottom wall of said container;

said compactor blade having a front face extending between said edges and facing said front wall of said container, and a rear face extending between said edges and facing said rear wall of said container;

said compactor blade positioned at rest adjacent said front wall and adapted to reciprocate longitudinally in said container between said front wall and said rear wall;

said rear wall having an opening for removal of materials from said cavity;

a door member releasably covering said opening in said rear wall;

said front face of said compactor blade configured to compact materials relative to said bottom wall during linear movement in one direction towards said front wall of said container and said rear face of said compactor blade configured to compact materials relative to said bottom wall during linear movement in an opposite direction towards said rear wall of said container; and a mechanism for reciprocating said compactor blade longitudinally in said single cavity in said container.

2. The compacting waste container as described in claim 1 wherein said opening in said top wall is adjacent said rest position of said compactor blade.

3. The compacting waste container as described in claim 1 further comprising guide rail members on said two side walls for assisting longitudinal movement of said compactor blade in said container.

4. The compacting waste container as described in claim 1 wherein said mechanism is a hydraulic system.

5. The compacting waste container as described in claim 1 further comprising a platform member positioned in said container between said top wall and said bottom wall and extending between the two side walls.

6. The compacting waste container as described in claim 5 wherein said platform member is positioned adjacent said lower edge of said compactor blade.

7. The compacting waste container as described in claim 6 wherein said opening in said top wall is located vertically aligned with platform member.

8. A compacting waste container comprising a plurality of wall members forming an enclosure for collection of waste materials, said wall members comprising a top wall, a bottom wall, a front wall and a rear wall;

said top wall having an opening disposed in the middle of the enclosure between the front wall and the rear wall;

a compactor member positioned in said enclosure and having an upper edge and a lower edge disposed in spaced relationship with said bottom wall;

said compactor member having a front face extending between said upper and lower edges and facing said front wall of said enclosure, and a rear face extending between said upper and lower edges and facing said rear wall of said enclosure;

said compactor member being positioned at rest below said opening in said top wall member;

a mechanism for reciprocating said compactor member longitudinally in said enclosure, both toward said front wall and toward said rear wall;

a platform member positioned in said enclosure parallel to said top wall, said platform member spaced from the rear wall and said front wall;

said platform member positioned adjacent the lower edge of said compactor member;

wherein waste materials introduced into the enclosure through the opening and positioned on said platform member are transferred from the platform member by said front face of said compactor member to the bottom wall during movement in a first direction toward the front wall and transferred from the platform member by said rear face of said compactor member to the bottom wall during movement in an opposite direction toward the rear wall.

9. The compacting waste container as described in claim 8 further comprising a cross-wall member positioned between said platform member and said bottom wall dividing said enclosure into two separate compartments.

10. The compacting waste container as described in claim 9 wherein said cross-wall member is pivotably attached to a sidewall of said container, wherein waste materials located in said two separate compartments can be evacuated independently.

11. The compacting waste container as described in claim 10 wherein said waste materials are evacuated by raising one end of the container.

12. The compacting waste container as described in claim 8 further comprising a door member positioned in said front wall.

13. The compacting waste container as described in claim 8 further comprising a door member positioned in said rear wall.

14. The compacting waste container as described in claim 8 wherein said mechanism for moving said compactor member comprises a hydraulic system.

15. A waste collection system, comprising:

a trailer having a base member and a plurality of wheels, said trailer adapted to be attached to and towed by a vehicle;

a container positioned on said trailer base member;

said container having a front wall, a rear wall, side walls, a top wall and a bottom wall, said front, rear, side, top and bottom walls forming a collection enclosure for materials;

said collection enclosure having a height between said bottom wall and said top wall;

a compactor member positioned in said collection enclosure adjacent said front wall thereof;

said compactor member having an upper edge and a lower edge disposed in spaced relationship with said bottom wall of said collection enclosure;

said compactor member having a front face extending between said edges and facing said front wall of said container, and a rear face extending between said edges and facing said rear wall of said container a mechanism for reciprocating said compactor member longitudinally in said collection enclosure to compact materials with said front face of said compactor blade during movement in a first direction toward the front wall and compact materials with said rear face of said compactor blade during movement in an opposite direction toward the rear wall;

said rear wall having an opening therein for evacuation of materials collected in said collection cavity, and a door member covering said opening; and a mechanism for tilting said collection container to facilitate evacuation of materials from said collection container through said rear wall opening.

16. The waste collection system as described in claim 15 further comprising an opening in said top wall for entry of materials into said collection enclosure.

17. The waste collection system as described in claim 15 wherein said mechanism for moving said blade member comprises a hydraulic actuation mechanism.

18. The waste collection system as described in claim 15 wherein said compactor member has its rest position adjacent said rear wall.

19. The waste collection system as described in claim 15 wherein said compactor member has its rest position adjacent said front wall.

20. The waste collection system as described in claim 15 wherein said compactor member has its rest position positioned substantially midway between said front and rear walls.

21. The waste collection system as described in claim 20 wherein said top wall has an opening for entry of materials into said collection enclosure, and wherein said opening is positioned midway between said front wall and said rear wall.

22. A waste collection system, comprising:

a vehicle having a base member for positioning of a collection container thereon;

said vehicle having a mechanism for tilting said collection container for evacuation of materials collected in said collection container;

said collection container having a front wall, a rear wall, side walls, a top wall and a bottom wall, said front, rear, side, top and bottom walls forming a collection enclosure for materials;

said collection enclosure having a height between said bottom wall and said top wall;

said top wall having an opening for loading trash into the collection enclosure;

a blade member positioned in said collection enclosure and having an upper edge and a lower edge disposed in spaced relationship with said bottom wall of said collection enclosure;

said blade member having a front face extending between said upper and lower edges and facing said front wall of said collection container, and a rear face extending between said edges and facing said rear wall of said collection container;

a mechanism for reciprocating said blade member longitudinally in said collection enclosure to compact materials with said front face of said blade member during movement in a first direction toward the front wall and compact materials with said rear face of said compactor blade during movement in an opposite direction toward the rear wall;

said rear wall having an opening therein for evacuation of materials collected in said collection enclosure, and a door member covering said opening; and wherein tilting of said collection container on said vehicle facilitates evacuation of materials through said opening in said rear wall.

23. The waste collection system as described in claim 22 wherein said collection container is a waste material collection and compacting container, and said blade member is a compactor blade member.

24. The waste collection system as described in claim 22 wherein said mechanism for moving said blade member comprises a hydraulic actuation mechanism.

25. The waste collection system as described in claim 22 wherein said vehicle is a truck and said base member comprises a bed of said truck.

26. The waste collection system as described in claim 22 wherein said tilting mechanism comprises a hydraulic activating system.

27. The waste collection system as described in claim 22 wherein the opening is positioned at a center length of the top wall; and a rest position of the compaction blade is adjacent the opening.

28. A method for compacting waste materials, said method comprising the steps of:

providing a waste container having two side walls, a front wall, and an end wall, a bottom wall and a top wall, and having an opening in the top wall for receiving compactable waste materials;

said waste container having a first distance between the two side walls and a first height between said bottom wall and said top wall;

providing a compactor blade inside said waste collection system;

said compactor blade having an upper edge, a lower edge disposed in spaced relationship with said bottom wall, a front face extending between said edges and facing said front wall of said waste container, and a rear face extending between said edges and facing said rear wall of said waste container;

providing a mechanism for reciprocating said compactor blade longitudinally in said waste container;

moving said compactor blade longitudinally in said container towards said front wall to contact and compact a portion of said materials against said front wall with said front face of said compactor blade; and moving said compactor blade longitudinally in said container towards said rear wall to contact and compact a portion of said materials against said rear wall with said rear face of said compactor blade;

wherein waste materials in said container which are not compacted by said compactor blade settle adjacent said bottom wall of said container.

29. A method for compacting waste materials, said method comprising the steps of:

providing a waste container structure having two side walls, a front wall, a rear wall, a bottom wall and a top wall, and having an opening in the top wall for receiving compactable waste materials;

said container structure having a first distance between the two side walls and a first height Z between said bottom wall and said top wall;

providing a compactor blade inside said container structure;

said compactor blade having a height about 20-50% of said height Z measured from said top wall;

said opening in top wall being adjacent said rear wall;

said compactor blade has its rest position adjacent said rear wall;

providing a mechanism for selectively moving said compactor blade longitudinally in said container structure; and moving said compactor blade longitudinally in said container structure to contact and compact a portion of said waste materials against at least one of said walls;

providing lift cylinders to raise the container structure for evacuating materials therefrom; and providing a door member in said rear wall for evacuation of materials from said container structure;

wherein materials in said container structure can be evacuated under said compactor blade.

* * * * *